US005508001A

United States Patent [19]

Suzuki et al.

[11] Patent Number: 5,508,001

[45] Date of Patent: Apr. 16, 1996

[54] COPPER BASED ALLOY FOR ELECTRICAL AND ELECTRONIC PARTS EXCELLENT IN HOT WORKABILITY AND BLANKABILITY

[75] Inventors: Takeshi Suzuki; Tadao Sakakibara; Manpei Kuwahara; Takao Fukatami, all of Aizuwakamatsu, Japan

[73] Assignee: Mitsubishi Sindoh Co., Ltd., Tokyo, Japan

[21] Appl. No.: 386,654

[22] Filed: Feb. 10, 1995

Related U.S. Application Data

[63] Continuation-in-part of Ser. No. 151,516, Nov. 12, 1993, abandoned.

[30] Foreign Application Priority Data

Nov. 13, 1992 [JP] Japan ..... 4-328806

[51] Int. Cl.[6] ..... C22C 9/02

[52] U.S. Cl. ..... 420/472; 420/473; 148/433; 148/434; 148/435

[58] Field of Search ..... 420/472, 473; 148/433, 434, 435

[56] References Cited

U.S. PATENT DOCUMENTS

| | | | |
|---|---|---|---|
| 4,750,029 | 6/1988 | Futatsuka et al. | 420/472 |
| 4,971,758 | 11/1990 | Suzuki et al. | 420/472 |
| 5,002,732 | 3/1991 | Yamasaki et al. | 420/473 |
| 5,024,814 | 6/1991 | Futatasuka et al. | 420/472 |

FOREIGN PATENT DOCUMENTS

| | | |
|---|---|---|
| 60-245754 | 12/1985 | Japan . |
| 2-66131 | 3/1990 | Japan . |
| 2-194138 | 7/1990 | Japan . |
| 3-56636 | 3/1991 | Japan . |

*Primary Examiner*—Sikyin Ip

*Attorney, Agent, or Firm*—Frishauf, Holtz, Goodman, Langer & Chick

[57] ABSTRACT

A copper based alloy for use as a material for electrical and electronic parts has a chemical composition by weight, of 0.5 to 3% Ni, 0.1 to 0.9% Sn, 0.08 to 0.8% Si, 0.1 to 3 Zn, 0.007 to 0.25% Fe, 0.001 to 0.2% P, 0.001 to 0.2% Mg, 0.0001 to 0.001% C, and if required, further containing 0.001 to 0.3% at least one element of Cr and Zr, and the balance being Cu and inevitable impurities. The obtained copper alloy is excellent in electric conductivity, solder-exfoliation resistance when bent, high-temperature creep strength, and migration resistance, while being superior in hot workability and blankability to the conventional copper based alloy.

2 Claims, No Drawings

COPPER BASED ALLOY FOR ELECTRICAL AND ELECTRONIC PARTS EXCELLENT IN HOT WORKABILITY AND BLANKABILITY

CROSS-REFERENCE TO RELATED CASES

The present application is a continuation-in-part application Ser. No. 08/151,516 filed Nov. 12, 1993, now abandoned, the entire text of which is incorporated herein by reference.

BACKGROUND OF THE INVENTION

1. Field of the Invention

This invention relates to a copper based alloy (hereinafter referred to as "Cu alloy") which is suitable for use as a material for various electrical and electronic parts.

2. Prior Art

Conventionally, in the manufacture of various kinds of electrical and electronic parts including connectors for electrical and electronic apparatus, a Cu alloy has been used, as proposed in Japanese Provisional Patent Publication (Kokai) No. 3-56636 (hereinafter referred to as "the conventional Cu alloy"), which has a chemical composition consisting essentially, by weight percent (hereinafter referred to as "%"), of 0.5 to 3% nickel (Ni), 0.1 to 0.9% tin (Sn), 0.08 to 0.8% silicon (Si), 0.1 to 3% zinc (Zn), 0.007 to 0.25% iron (Fe), 0.001 to 0.2% phosphorus (P), and the balance of copper (Cu) and inevitable impurities.

The conventional Cu alloy possesses excellent properties required of materials for electrical and electronic parts, such as electric conductivity, high-temperature creep strength, migration resistance, plated-surface blister resistance, and solder-exfoliation resistance when bent. Therefore, the conventional Cu alloy has played an important role in realizing miniaturization and higher integration of electrical and electronic parts, as well as in enabling to withstand use under high temperature and high humidity conditions.

However, with the recent progress of mass-production of electrical and electronic parts, there has been an increasing demand for reduced manufacturing costs or reduced working costs of these parts, and accordingly there has also been an increasing demand for reduced manufacturing costs or reduced working costs of materials for these parts.

To meet these demands, attempts have been made to reduce the manufacturing cost by preparing a large-sized Cu alloy ingot to thereby decrease the number of times of preparation of the ingots, and to reduce the working cost by increasing the speed of blanking or stamping a Cu alloy sheet to thereby increase the number of electrical and electronic parts manufactured per unit time. However, those attempts have the following disadvantages:

(1) To roll the large-sized Cu alloy ingot into a plate requires an increased number of times of hot working. However, the conventional Cu alloy has insufficient hot workability such that the hot rolled ingot can have cracks formed therein after it has been subjected to a number of times of hot working. Therefore, the manufacturing cost cannot be reduced even if a large-sized Cu alloy ingot is used.

(2) Moreover, Cu alloy sheets prepared from the conventional Cu alloy have poor blankability such that high-speed blanking of the Cu alloy sheet in manufacturing electrical and electronic parts causes heavy wear of the blanking die, requiring severe maintenance of the blanking die and an increased number of times of replacement thereof with a new one. Therefore, no reduction of the working cost can be achieved.

SUMMARY OF THE INVENTION

It is the object of the invention to provide a Cu alloy for use as a material for electrical and electronic parts, which is excellent in electric conductivity, solder-exfoliation resistance when bent, high-temperature creep strength, and migration resistance, as well as in hot workability and blankability.

To attain the above object, the present invention provides a Cu alloy having a chemical composition consisting essentially of 0.5 to 3% Ni, 0.1 to 0.9% Sn, 0.08 to 0.8% Si, 0.1 to 3% Zn, 0.007 to 0.25% Fe, 0.001 to 0.2% P, 0.001 to 0.2% Mg, C: 0.0001 to 0.001%, and the balance being Cu and inevitable impurities.

To attain the object, the present invention further provides a Cu alloy having a chemical composition consisting essentially of 0.5 to 3% Ni, 0.1 to 0.9% Sn, 0.08 to 0.8% Si, 0.1 to 3% Zn, 0.007 to 0.25% Fe, 0.001 to 0.2% P, 0.001 to 0.2% Mg, C: 0.0001 to 0.001%, 0.001 to 0.3% at least one element selected from the group consisting of Cr and Zr, and the balance being Cu and inevitable impurities.

The above and other objects, features and advantages of the invention will be more apparent from the following detailed description.

DETAILED DESCRIPTION

Under the aforestated circumstances, the present inventors have made studies in order to obtain a Cu alloy which is as excellent in electric conductivity, solder-exfoliation resistance when bent, high-temperature creep strength, migration resistance as the conventional Cu alloy, while possessing satisfactory hot workability and blankability, and have reached the following finding:

If 0.001 to 0.2% Mg and 0.0001 to 0.001% C, and further, if required, 0.001 to 0.3% at least one or both of Cr and Zr are added to the conventional Cu alloy having a chemical composition consisting essentially of 0.5 to 3% Ni, 0.1 to 0.9% Sn, 0.08 to 0.8% Si, 0.1 to 3% Zn, 0.007 to 0.25% Fe, 0.001 to 0.2% P, and the balance of Cu and inevitable impurities, the resulting Cu alloy has formed therein a reduced number of cracks caused by hot working and permits a reduced amount of wear of the blanking die caused by blanking, without degrading various excellent properties of the conventional Cu alloy.

The present invention is based upon the above finding.

The Cu alloy for use as a material for electric and electronic parts according to the invention has a chemical composition consisting essentially of 0.5 to 3 Ni, 0.1 to 0.9% Sn, 0.08 to 0.8% Si, 0.1 to 3% Zn, 0.007 to 0.25% Fe, 0.001 to 0.2% P, 0.001 to 0.2% Mg, 0.0001 to 0.001% C, and if required, further containing 0.001 to 0.3% at least one element selected from the group consisting of Cr and Zr, and the balance of Cu and inevitable impurities, and possesses excellent hot workability and blankability in addition to the aforesaid excellent properties of the conventional Cu alloy.

The contents of the component elements of the Cu alloy according to the invention have been limited as stated above, for the following reasons:

(a) Ni and Si

The Ni and Si components cooperatively act to form a compound thereof which serves to greatly increase the strength and the springiness, raise the softening point of the Cu alloy, and increase the high-temperature creep strength, without drastically degrading the electric conductivity. However, if the Ni content is less than 0.5%, or if the Si content is less than 0.08%, the compound of Ni and Si cannot be formed in a sufficient amount, and accordingly the above action cannot be performed to a desired extent. On the other hand, if the Ni content exceeds 3%, or if the Si content exceeds 0.8%, the Cu alloy will have degraded hot rollability and degraded electric conductivity. Therefore, the Ni content has been limited to the range of 0.5 to 3%, and preferably to a range of 1.3 to 2.7%, and the Si content to the range of 0.08 to 0.8%, and preferably to a range of 0.2 to 0.8%.

(b) Sn

The Sn component acts to further improve the springiness and the bendability of the Cu alloy. However, if the Sn content is less than 0.1%, the above action cannot be performed to a desired extent. On the other hand, if the Sn content exceeds 0.9%, it will cause degradation in the migration resistance and the electric conductivity. Therefore, the Sn content has been limited to the range of 0.1 to 0.9%, and preferably to a range of 0.2 to 0.79%.

(c) Zn

The Zn component acts to improve the solder-exfoliation resistance of the Cu alloy when bent, and the migration resistance. However, if the Zn content is less than 0.1%, the above action cannot be performed to a desired extent. On the other hand, if the Zn content exceeds 3%, the Cu alloy has degraded solderability. Therefore, the Zn content has been limited to the range of 0.1 to 3%, and preferably to a range of 0.4 to 2.0%.

(d) Fe

The Fe component acts to improve the hot rollability (the effect of restraining occurrence of surface cracks or ear cracks in the Cu alloy), and reduce the grain size of precipitates of the compound of Ni and Si to thereby improve the adhesion strength of a plated surface of the Cu alloy when heated and hence the reliability of the Cu alloy part. However, if the Fe content is less than 0.007%, the above action cannot be performed to a desired extent. On the other hand, if the Fe content exceeds 0.25%, the hot rollability is no longer improved but rather degraded, and the electric conductivity can be adversely affected. Therefore the Fe content has been limited to the range of 0.007 to 0.25%, and preferably to a range of 0.01 to 0.12%.

(e) P

The P component acts to restrain degradation in the springiness of the Cu alloy when bent to thereby facilitate the insertion and removal of the Cu alloy part if the Cu alloy is applied to a connector or the like, and to improve the migration resistance of the same. However, if the P content is less than 0.001%, the above action cannot be performed to a desired extent. On the other hand, if the P content exceeds 0.2%, the Cu alloy will have degraded solder-exfoliation resistance when heated. Therefore, the P content has been limited to the range of 0.001 to 0.2 and preferably to a range of 0.002 to 0.10%.

(f) Mg

The Mg component acts to suppress the formation of cracks caused by hot rolling, which is attributable to solidification strain which is more prominent in an ingot having an increased size and to segregation of impurities including sulfur (S). The Mg component also acts to improve the blankability to thereby reduce the wear of the blanking die. However, if the Mg content is less than 0.001%, the above action cannot be performed to a desired extent, whereas if the Mg content exceeds 0.2%, a magnesium oxide can be formed in the ingot to thereby adversely affect the hot rollability (hot workability) of the Cu alloy ingot and even degrade the electric conductivity. Therefore, the Mg content has been limited to the range of 0.001 to 0.2%, and preferably to a range of 0.001 to 0.10%.

(g) C

The C component acts to enhance the blankability of the Cu alloy, and further acts to reduce the grain size of compounds of Ni and Si to thereby enhance the strength of the Cu alloy. However, if the C content is less than 0.0001%, the above actions cannot be performed to a satisfactory extent, whereas if it exceeds 0.001%, it will adversely affect the hot workability. Therefore, the C content has been limited to a range of 0.0001 to 0.001%, and preferably to a range of 0.0002 to 0.0008%.

(h) Cr and Zr

These components have high affinity for C such that when they are contained in the Cu alloy, C is easily solved into the Cu alloy. Further, the Cr and Zr components act to reduce the grain size of compounds of Ni and Si to further enhance the strength of the Cu alloy. However, if one or both of Cr and Zr are contained in an amount less than 0.001%, the above action of enhancing the strength cannot be performed to a satisfactory extent, whereas if the content of one or both of Cr and Zr exceeds 0.3%, large-sized precipitates of Cr and/or Zr can be formed, which degrades the plateability of the Cu alloy and even spoils the hot workability. Therefore, the content of one or both of Cr and Zr has been limited to a range of 0.001 to 0.3%, and preferably to a range of more than 0.01% and up to 0.2%.

An example of the invention will now be described hereinbelow.

EXAMPLE

Molten Cu alloys having chemical compositions shown in Tables 1 to 3 were prepared in a conventional low-frequency channel smelting furnace. The thus prepared molten alloys were cast by an ordinary semicontinuous casting method to form Cu alloy ingots each having a size of 170 mm in thickness, 520 mm in width, and 4800 mm in length. The ingots were each hot rolled at an initial hot rolling temperature within a range of 750° to 950° C. into a hot rolled plate having a thickness of 11 mm. The hot rolled plates were each quenched and then had its upper and lower sides scalped by 0.5 mm, into a thickness of 10 mm. The resulting scalped plates were each repeatedly and alternately cold rolled and annealed under ordinary conditions, and finally subjected to annealing at a predetermined temperature within a range of 250° to 550° C. for 1 hour, to thereby obtain Cu alloy sheets Nos. 1 to 26 according to the present invention, comparative Cu alloy sheets Nos. 1 to 6, and a conventional Cu alloy sheet, each having a thickness of 0.25 mm.

[TABLE 1]

| TEST PIECES | CHEMICAL COMPOSITION (Wt %) (BALANCE: Cu AND INEVITABLE IMPURITIES) | | | | | | | | | |
|---|---|---|---|---|---|---|---|---|---|---|
| | Ni | Si | Sn | Zn | Fe | P | Mg | C | Cr | Zr |
| Cu ALLOYS ACCORDING TO PRESENT INVENTION | | | | | | | | | | |
| 1 | 2.70 | 0.68 | 0.17 | 0.82 | 0.085 | 0.018 | 0.0015 | 0.0004 | — | — |
| 2 | 2.01 | 0.54 | 0.52 | 0.97 | 0.031 | 0.011 | 0.0023 | 0.0002 | — | — |
| 3 | 1.92 | 0.46 | 0.63 | 0.77 | 0.029 | 0.005 | 0.0038 | 0.0002 | — | — |
| 4 | 1.85 | 0.47 | 0.40 | 0.82 | 0.044 | 0.012 | 0.0046 | 0.0002 | — | — |
| 5 | 1.68 | 0.45 | 0.41 | 0.85 | 0.035 | 0.020 | 0.0062 | 0.0004 | 0.03 | — |
| 6 | 1.72 | 0.46 | 0.44 | 0.76 | 0.023 | 0.018 | 0.0078 | 0.0002 | — | — |
| 7 | 1.85 | 0.50 | 0.47 | 0.94 | 0.018 | 0.009 | 0.0095 | 0.0002 | — | — |
| 8 | 1.80 | 0.39 | 0.40 | 0.92 | 0.035 | 0.021 | 0.0132 | 0.0002 | — | — |
| 9 | 1.60 | 0.37 | 0.67 | 1.67 | 0.108 | 0.052 | 0.0432 | 0.0003 | — | 0.02 |
| 10 | 2.03 | 0.52 | 0.48 | 0.95 | 0.033 | 0.015 | 0.0510 | 0.0002 | — | — |
| 11 | 2.51 | 0.63 | 0.50 | 0.17 | 0.011 | 0.115 | 0.0704 | 0.0002 | — | — |

[TABLE 2]

| TEST PIECES | CHEMICAL COMPOSITION (Wt %) (BALANCE: Cu AND INEVITABLE IMPURITIES) | | | | | | | | | |
|---|---|---|---|---|---|---|---|---|---|---|
| | Ni | Si | Sn | Zn | Fe | P | Mg | C | Cr | Zr |
| Cu ALLOYS ACCORDING TO PRESENT INVENTION | | | | | | | | | | |
| 12 | 0.64 | 0.16 | 0.54 | 1.12 | 0.162 | 0.083 | 0.1050 | 0.0002 | — | — |
| 13 | 2.40 | 0.65 | 0.50 | 0.98 | 0.079 | 0.015 | 0.1228 | 0.0002 | — | — |
| 14 | 1.87 | 0.46 | 0.43 | 0.79 | 0.019 | 0.006 | 0.1520 | 0.0002 | — | — |
| 15 | 2.02 | 0.50 | 0.45 | 0.81 | 0.054 | 0.013 | 0.1694 | 0.0002 | — | — |
| 16 | 1.80 | 0.46 | 0.50 | 0.84 | 0.046 | 0.010 | 0.1801 | 0.0002 | — | — |
| 17 | 1.51 | 0.40 | 0.42 | 0.95 | 0.060 | 0.012 | 0.1991 | 0.0002 | — | — |
| 18 | 0.88 | 0.24 | 0.51 | 0.92 | 0.012 | 0.014 | 0.0035 | 0.0001 | — | — |
| 19 | 2.02 | 0.47 | 0.45 | 0.88 | 0.033 | 0.008 | 0.0043 | 0.0003 | 0.005 | — |
| 20 | 1.97 | 0.46 | 0.44 | 0.91 | 0.027 | 0.012 | 0.0027 | 0.0005 | 0.04 | 0.003 |
| 21 | 1.91 | 0.51 | 0.46 | 0.85 | 0.029 | 0.013 | 0.0044 | 0.0006 | 0.08 | 0.01 |
| 22 | 2.12 | 0.53 | 0.48 | 0.96 | 0.027 | 0.012 | 0.0041 | 0.0008 | 0.12 | 0.04 |

[TABLE 3]

| TEST PIECES | CHEMICAL COMPOSITION (wt %) (BALANCE: Cu AND INEVITABLE IMPURITIES) | | | | | | | | | |
|---|---|---|---|---|---|---|---|---|---|---|
| | Ni | Si | Sn | Zn | Fe | P | Mg | C | Cr | Zr |
| Cu ALLOYS ACCORDING TO PRESENT INVENTION | | | | | | | | | | |
| 23 | 1.95 | 0.46 | 0.45 | 0.85 | 0.088 | 0.012 | 0.0040 | 0.0009 | 0.18 | 0.1 |
| 24 | 1.98 | 0.45 | 0.46 | 0.87 | 0.030 | 0.012 | 0.0038 | 0.0004 | — | 0.2 |
| 25 | 2.11 | 0.49 | 0.54 | 0.87 | 0.033 | 0.009 | 0.0042 | 0.0004 | 0.2 | — |
| 26 | 2.02 | 0.52 | 0.46 | 0.89 | 0.027 | 0.013 | 0.0039 | 0.0004 | 0.05 | 0.04 |
| COMPARATIVE Cu ALLOYS | | | | | | | | | | |
| 1 | 0.63 | 0.17 | 0.54 | 0.95 | 0.145 | 0.081 | 0.0007* | 0.0001 | — | — |
| 2 | 1.92 | 0.46 | 0.49 | 0.71 | 0.027 | 0.005 | 0.2350* | 0.0002 | — | — |
| 3 | 0.61 | 0.12 | 0.34 | 0.85 | 0.022 | 0.008 | 0.0011 | 0.00005* | — | — |
| 4 | 2.58 | 0.64 | 0.48 | 0.96 | 0.238 | 0.012 | 0.0015 | 0.0012* | 0.2 | 0.09 |
| 5 | 1.94 | 0.63 | 0.48 | 0.97 | 0.012 | 0.024 | 0.0013 | 0.0002 | 0.4* | — |
| 6 | 1.98 | 0.55 | 0.44 | 0.94 | 0.010 | 0.018 | 0.0021 | 0.0002 | — | 0.4* |
| CONVENTIONAL Cu ALLOY | 2.03 | 0.49 | 0.52 | 0.95 | 0.037 | 0.012 | — | — | — | — |

(Note: Asterisked values fall outside the ranges of the present invention.)

To evaluate the hot workability of each of the Cu alloys, at the above scalping step, each of the Cu alloy plates shown in Tables 1 to 3 was examined as to the number of side edge cracks having a length of 5 mm or more and the maximum length of the side edge cracks by visual observation over the whole length of the hot rolled plate. The results are shown in Tables 4 to 6.

Hot rolled plates where side edge cracks having a length of 5 mm or more were found had the side edge crack portions slitted out after rough hot rolling to remove the crack portions thereof, and thereafter they were subjected to the same steps as the hot rolled plates where no side edge crack having a length of 5 mm or more was found.

The thus prepared Cu alloy sheets Nos. 1 to 26 according to the present invention, the comparative Cu alloy sheets Nos. 1 to 6, and the conventional Cu alloy sheet were each subjected to tests as to tensile strength, electric conductivity and blankability under the following conditions:

(1) Tensile Test:

Test pieces were used, which were cut out of the respective Cu alloy sheets in the direction of rolling in accordance with JIS (Japanese Industrial Standard) Test Piece No. 5, and tested as to the tensile strength and the elongation. The test results are shown in Tables 4 to 6.

(2) Test as to Electric Conductivity:

The Cu alloy sheets were each tested as to the electric conductivity in accordance with JIS H 0505. The test results are shown in Tables 4 to 6.

(3) Test as to Blankability

A commercially available blanking die formed of a WC-based hard metal having a chemical composition of 16% Co and the balance of WC was employed to blank or punch circular chips. First, one million of circular chips with a diameter of 5 mm were blanked from each of the Cu alloy sheets. 20 chips obtained immediately after the start of the blanking and 20 chips obtained immediately before the termination of the same were selected, the diameters of which were measured. An amount of change in the diameter was determined from two average diameter values of the respective groups of 20 chips, to adopt it as the amount of wear. The amount of wear of the conventional Cu alloy sheet in Table 3 was set as a reference value of 1, and the wear amounts of the other Cu alloy sheets were converted into values of a ratio relative to the reference value, as shown in Tables 4 to 6.

[TABLE 4]

| TEST PIECES | TENSILE STRENGTH ($N/mm^2$) | ELONGATION (%) | ELECTRIC CONDUCTIVITY (IACS %) | BLANKING DIE WEAR (RELATIVE (VALUE) | HOT WORKABILITY: NUMBER OF CRACKS HAVING LENGTH OF 5 mm OR MORE | HOT WORKABILITY: MAXIMUM CRACK LENGTH (mm) |
|---|---|---|---|---|---|---|
| | | Cu ALLOYS ACCORDING TO PRESENT INVENTION | | | | |
| 1 | 620 | 9 | 44 | 0.61 | 0 | 0 |
| 2 | 585 | 9 | 45 | 0.58 | 0 | 0 |
| 3 | 595 | 8 | 43 | 0.58 | 0 | 0 |
| 4 | 585 | 7 | 48 | 0.58 | 0 | 0 |
| 5 | 590 | 7 | 48 | 0.53 | 0 | 0 |
| 6 | 580 | 8 | 46 | 0.57 | 0 | 0 |
| 7 | 590 | 7 | 45 | 0.56 | 0 | 0 |
| 8 | 585 | 7 | 44 | 0.56 | 0 | 0 |
| 9 | 585 | 8 | 41 | 0.54 | 0 | 0 |
| 10 | 585 | 8 | 44 | 0.56 | 0 | 0 |
| 11 | 605 | 8 | 44 | 0.56 | 0 | 0 |

[TABLE 5]

| TEST PIECES | TENSILE STRENGTH ($N/mm^2$) | ELONGATION (%) | ELECTRIC CONDUCTIVITY (IACS %) | BLANKING DIE WEAR (RELATIVE (VALUE) | HOT WORKABILITY: NUMBER OF CRACKS HAVING LENGTH OF 5 mm OR MORE | HOT WORKABILITY: MAXIMUM CRACK LENGTH (mm) |
|---|---|---|---|---|---|---|
| | | Cu ALLOYS ACCORDING TO PRESENT INVENTION | | | | |
| 12 | 570 | 7 | 45 | 0.55 | 0 | 0 |
| 13 | 605 | 9 | 43 | 0.57 | 0 | 0 |
| 14 | 585 | 8 | 42 | 0.53 | 0 | 0 |
| 15 | 585 | 9 | 42 | 0.54 | 0 | 0 |
| 16 | 585 | 9 | 42 | 0.52 | 0 | 0 |
| 17 | 575 | 9 | 41 | 0.48 | 0 | 0 |
| 18 | 570 | 8 | 45 | 0.58 | 0 | 0 |
| 19 | 590 | 8 | 42 | 0.57 | 0 | 0 |
| 20 | 600 | 7 | 43 | 0.55 | 0 | 0 |
| 21 | 605 | 8 | 42 | 0.53 | 0 | 0 |
| 22 | 620 | 8 | 41 | 0.52 | 0 | 0 |

[TABLE 6]

| TEST PIECES | TENSILE STRENGTH ($N/mm^2$) | ELONGATION (%) | ELECTRIC CONDUCTIVITY (IACS %) | BLANKING DIE WEAR (RELATIVE (VALUE) | HOT WORKABILITY NUMBER OF CRACKS HAVING LENGTH OF 5 mm OR MORE | HOT WORKABILITY MAXIMUM CRACK LENGTH (mm) |
|---|---|---|---|---|---|---|
| Cu ALLOYS ACCORDING TO PRESENT INVENTION | | | | | | |
| 23 | 630 | 8 | 40 | 0.50 | 0 | 0 |
| 24 | 605 | 9 | 42 | 0.55 | 0 | 0 |
| 25 | 615 | 8 | 41 | 0.54 | 0 | 0 |
| 26 | 610 | 8 | 42 | 0.55 | 0 | 0 |
| COMPARATIVE Cu ALLOYS | | | | | | |
| 1 | 550 | 7 | 46 | 0.87 | 4 | 20 |
| 2 | 595 | 8 | 34 | 0.47 | 2 | 20 |
| 3 | 530 | 9 | 48 | 0.75 | 0 | 0 |
| 4 | 645 | 9 | 39 | 0.46 | 4 | 25 |
| 5 | 610 | 9 | 36 | 0.68 | 5 | 25 |
| 6 | 605 | 8 | 37 | 0.65 | 3 | 20 |
| CONVENTIONAL Cu ALLOY | 580 | 8 | 46 | 1.00 | 7 | 45 |

It will be learned from Tables 1 to 6 that the Cu alloy sheets Nos. 1 to 26 according to the present invention have much more excellent degrees of the effect of restraining the wear of the blanking die since they exhibit much smaller amounts of wear as compared with the conventional Cu alloy sheet, while possessing as excellent tensile strength, elongation and electric conductivity as the conventional Cu alloy sheet. Thus, the Cu alloys according to the present invention are excellent in blankability. Furthermore, no crack caused by hot working was found in the Cu alloy sheets according to the present invention, which indicates that the Cu alloys according to the present invention are excellent in hot workability, as well.

However, the comparative Cu alloy No. 2 where the Mg content is more than 0.2% shows degraded electric conductivity and occurrence of cracks. Further, the comparative Cu alloy No. 1 where the Mg content is less than 0.001% cannot exhibit the effects obtained by the addition of Mg to a desired extent.

Further, the comparative Cu alloy No. 4 where the C content exceeds 0.001% shows degraded hot workability. Besides, the comparative Cu alloy No. 3 where the C content is less than 0.0001% cannot exhibit the effects obtained by the addition of C to a desired extent.

Furthermore, it will be learned from the tables that the addition of Cr and/or Zr causes a further improvement in the tensile strength of the Cu alloy, as is found in the Cu alloys according to the present invention. However, it should be noted that the comparative Cu alloys Nos. 5 and 6 where Cr and/or Zr is contained in an amount exceeding 0.3% show degraded hot workability.

Each of the Cu alloy sheets Nos. 1 to 26 according to the present invention and the comparative Cu alloys Nos. 1 to 6 was measured as to a spring limit value obtained in an initial state thereof immediately after preparation thereof, a decrease rate of the spring limit value due to bending, a stress relaxation ratio (high-temperature creep strength), solder exfoliation when bent, plated-surface blister, maximum current leakage (migration resistance), etc. As a result, it was found that there was no difference in the results of measurements between the Cu alloy sheets according to the present invention and the conventional Cu alloy, and hence it was confirmed that addition of Mg and C within the respective ranges according to the present invention does not adversely affect the properties of the conventional Cu alloy.

As described above, the Cu alloy for use as a material for electrical and electronic parts according to the present invention possesses superior hot workability and blankability to those of the conventional Cu alloy, while exhibiting as excellent electric conductivity, high-temperature creep strength, migration resistance, plated-surface blister resistance, and solder exfoliation resistance when bent as the conventional Cu alloy. Therefore, if the Cu alloy according to the present invention is subjected to hot working in manufacturing sheets thereof, large cracks are not formed by the hot working, and hence it is unnecessary to slit the plates to remove large crack portions, to thereby improve the yield. Further, since the Cu alloy according to the present invention is excellent in blankability, it is possible to decrease the number of times of repair and replacement of the blanking die, resulting in improved efficiency of manufacture of electrical and electronic parts or an increased productivity, which brings about industrially useful effects.

What is claimed is:

1. A copper based alloy for use as a material for electrical and electronic parts, which is excellent in electric conductivity solder-exfoliation resistance when bent, high-temperature creep strength, and migration resistance, as well as in hot workability and blankability, consisting essentially, by weight percent, of 1.3 to 2.7% Ni, 0.2 to 0.79% Sn, 0.2 to 0.8% Si, 0.4 to 2.0% Zn 0.01 to 0.12% Fe, 0.002 to 0.10% P, 0.001 to 0.10% Mg, 0.0002 to 0.0008% C, and the balance being Cu and inevitable impurities.

2. A copper based alloy for use as a material for electrical and electronic parts, which is excellent in electric conductivity, solder-exfoliation resistance when bent, high-temperature creep strength, and migration resistance, as well as in hot workability and blankability, consisting essentially, by weight percent, of 1.3 to 2.7% Ni, 0.2 to 0.79% Sn, 0.2 to 0.8% Si, 0.4 to 2.0% Zn, 0.01 to 0.12% Fe, 0.002 to 0.10% P, 0.001 to 0.10% Mg, 0.0002 to 0.0008% C, more than 0.01% and up to 0.2% at least one element selected from the group consisting of Cr and Zr, and the balance being Cu and inevitable impurities.

* * * * *

UNITED STATES PATENT AND TRADEMARK OFFICE

CERTIFICATE OF CORRECTION

PATENT NO. : 5,508,001

DATED : April 16, 1996

INVENTOR(S) : SUZUKI et al

It is certified that error appears in the above-indentified patent and that said Letters Patent is hereby corrected as shown below:

Title Page, Right Column, in the ABSTRACT, line 2: After "composition" insert --,--.

Column 10, line 48, Claim 1: before "solder-exfoliation" insert --,--.

Signed and Sealed this

Fourteenth Day of July, 1998

Bruce Lehman

*Attest:*

BRUCE LEHMAN

*Attesting Officer*

*Commissioner of Patents and Trademarks*